US006915754B2

(12) United States Patent
Tsuyoshi Komura et al.

(10) Patent No.: US 6,915,754 B2
(45) Date of Patent: Jul. 12, 2005

(54) APPARATUS AND METHOD OF OPERATION FOR QUICK ANCHORING EQUIPMENT

(75) Inventors: Adolfo Tsuyoshi Komura, Macae (BR); José Célio Sinquini, Macaé (BR); Ricardo Wagner Capllonch, Rio De Janeiro (BR); Rogério Diniz Machado, Macaé (BR)

(73) Assignee: Petroleo Brasileiro S.A., Petrobras (BR)

( * ) Notice: Subject to any disclaimer, the term of this patent is extended or adjusted under 35 U.S.C. 154(b) by 0 days.

(21) Appl. No.: 10/620,774

(22) Filed: Jul. 17, 2003

(65) Prior Publication Data

US 2004/0123788 A1 Jul. 1, 2004

(30) Foreign Application Priority Data

Nov. 19, 2002 (BR) ..... PI0204708-0

(51) Int. Cl.[7] ..... B63B 21/50
(52) U.S. Cl. ..... 114/293; 405/224
(58) Field of Search ..... 114/293–296, 230.2, 114/230.25, 230.26, 230.3; 405/224

(56) References Cited

U.S. PATENT DOCUMENTS 4,509,448 A * 4/1985 Pease et al. ..... 114/293
6,223,671 B1 * 5/2001 Head ..... 114/230.2
6,719,497 B1 * 4/2004 Pollack et al. ..... 405/224

FOREIGN PATENT DOCUMENTS

BR 9700787 A 12/1998

* cited by examiner

*Primary Examiner*—Andrew D. Wright
(74) *Attorney, Agent, or Firm*—Nixon & Vanderhye PC

(57) ABSTRACT

The invention is comprised of a Quick Anchoring Equipment system (30) which permits underwater connection and disconnection of anchoring lines (2) to anchoring devices that are already fixedly attached to the bottom of the sea. The Quick Anchoring Equipment (30) consists of chain cable, cables, hooks and buoys specifically organized and configured, which, are attached at the submerged end of the anchoring line (2), which makes it possible with a single support boat (5), together with a remote operated vehicle (6), to carry out this whole anchoring lines (2) operation fundamental to floating platforms (1). The invention also includes the method to install and uninstall the Quick Anchoring Equipment (30).

15 Claims, 8 Drawing Sheets

APPARATUS AND METHOD OF OPERATION FOR QUICK ANCHORING EQUIPMENT

SCOPE OF THE INVENTION

The present invention is comprised of apparatus for use in anchoring floating structures, such as platforms used for oil prospecting, or other applications related to anchoring equipment or submarine structures. More specifically, the invention is comprised of a system for quick underwater connection and disconnection of anchoring lines.

STATE OF THE ART

Exploration for oil in deep waters requires the use of floating platforms, which need to be anchored to the sea bed in order to operate as a drilling unit or for oil well exploration, for example. This anchorage is made through anchoring equipment including an anchoring line, an anchor and a means to fixedly attach the anchor to the sea bed.

Keeping in mind the ever-increasing depths where floating oil platforms are operating (currently around 2000 m), the weight placed on the floating structure by traditional anchoring lines (chains made of steel) is unacceptable.

Faced with this situation, anchoring these platforms is now being performed by anchoring lines made of synthetic ropes, which are lighter, and that fulfill the purpose of reducing the load on the platforms due to the fact that the weight of these lines is more appropriate.

However, in order to allow the use of synthetic ropes (for example, polyester), on floating platform anchoring systems, certifying companies require that they be withdrawn periodically (after short periods of time), so that they may be inspected.

Consequently, the whole operation of disconnecting the anchor from its point of attachment in the sea bed must also be carried out at short intervals of time. This operation is protracted, requiring the employment of a large team and the use of several boats, which makes the task very onerous.

Moreover, the more necessary it is to operate with floating platforms in great depths, the more onerous and slow will be the work of setting or jetting for stakes, for anchorage.

Therefore special anchors for this type of application had been developed, which are used at the present time. These anchors can be classified in two main categories: suction and vertical load.

The suction anchors include equipment that is in the form of an inverted cup. This cup is embedded into the sea bed by means of the vacuum created in its interior. Vertical load anchors are made of a flat plate, in several different formats, that stakes itself into the sea bed by means of dragging.

In addition to this technology, it is already currently possible to connect and disconnect anchoring lines to/from a fixed point in the sea bed without needing to remove and later reattach everything from/to the point of attachment on the floor of the ocean for each and every inspection.

An example of this more recent technology is the patent belonging to the petitioner, BR-PI9700787 filed on Jan. 28, 1997 and granted on May 28, 2002. This patent describes the use of a hook (together with devices to connect it to a loop) to enable a connection between the anchoring line and a fixed point on the sea bed.

The entire operation is carried out using two boats on the surface of the ocean and with no need for the intervention of divers. The operation may be realized by using a tugboat and a floating platform or with two support boats.

This operation basically involves the following steps:

Place a hook on a chain cable attached to the sea bed. This hook has the approximate shape of a "U". The shorter end connects to the chain cable using known technical devices, and the other, longer end is provided with a ring. This ring is attached to a fairlead that goes to the towboat on the ocean surface. The end of the anchoring line will descend down the fairlead;

The tugboat keeps the fairlead tight, and consequently the larger end of the hook is in a vertical position. The anchoring line descends down the fairlead, from the floating platform or from a support boat, until it connects itself to the hook;

At this moment, the fairlead is given slack, and the anchoring line must simultaneously be held tight. When this is done, a rotation will occur and as a consequence, the position of the hook will be reversed, which guarantees a connection between the anchoring line and the chain cable embedded in the sea bed;

Next, a quick pull is given to the fairlead which makes it break in the pre-weakened section to finalize the operation. And with this, the complementary secure hook system is set up.

As it can be observed, this operation is laborious, and requires synchronization of at least two teams.

Another inconvenience that should be mentioned, is the time spent due to poor visibility where the teams are working, as a consequence of the mud in suspension caused by the movements of the ropes on the sea bed. This inconvenience is common to all the known anchoring techniques. The lack of visibility delays and makes operations requiring remote control vehicle operator precision difficult. The same is true when divers are used.

It should be pointed out that in the currently used technique, existing anchoring devices used on large floating structures, generally keep the hook attached to chain cables placed in the deep ocean to facilitate the anchoring procedure. However, in case of a possible change in the location of the floating platform's point of operation, all the equipment, including the hook (all of which is expensive), is usually abandoned on the sea bed.

PURPOSE OF THE INVENTION

To reduce costs and speed up operations of disconnection and subsequent reconnection of anchoring lines, it has become necessary to provide ways that involve less time, less equipment and less skilled workers than the now know techniques, as well as eliminating the possibility of having to abandon the connection hook together with the chain cable in the depths of the ocean. To this end, the present invention was developed. It allows the use of the same hook mentioned above for anchoring floating platforms, but it reduces the number of boats, skilled workers and time involved in this fundamental operation necessary to all large floating off-shore structures.

SUMMARY OF THE INVENTION

The present invention is comprised of the apparatus and method for Quick Anchoring.

First, the invention is comprised of anchoring equipment that includes an organized fusion of known technical elements, such as chain cable, steel cable, hooks, and the respective devices for fixation, which are connected to the submerged end of an anchoring line. Preferably, the anchoring line should be made of synthetic material.

The quick anchoring system is linked to anchoring devices which are fixedly attached to the sea bed, such as: stakes or suction anchors rigidly fixed to the sea bed, chain cable and shackles supported by buoys.

The quick anchoring system basically includes:

A length (L1) of chain cable;

A length of cable attached (L3) to the upper end of the chain cable;

The free end of the cable segment is provided with a fastener;

A buoy is attached to the fastener;

The lower end of the chain cable is provided with an open link or hook;

The free side of the open link or hook is provided with a ring;

A length (L2) of the fairlead is permanently connected to the ring;

The free end of the fairlead is provided with a loop;

The system of quick anchoring works in harmony with anchoring devices fixedly attached to the sea bed, and is provided with a length (L4) of chain cable, to which is connected a shackle supported by buoys.

The length (L1) of chain cable is parallel to the precision ray [laser] that a boat uses to place itself over the position of the stake in the sea bed.

The cable segment is of sufficient length (L3) to keep the fastener out of the area of poor visibility on the sea bed.

The fairlead has a length (L2) equal to the difference between lengths (L1) and (L3).

The length (L4) of the anchoring device chain cable is longer than the height of poor visibility caused by movements on the sea bed.

Second, the invention includes a method for connecting the quick anchoring system to the fixedly attached anchoring device on the sea bed, which includes the following steps:

Take an anchoring line that has the quick anchoring system described above attached to one of its ends, out on a boat, until a position on the surface of the ocean is reached that is vertically above the anchoring device;

Lower the anchoring line and the quick anchoring system in a direction towards the anchoring device;

Stop the descent of the anchoring line when the loop reaches a height of (L5) from the sea bed;

Using a remote operated vehicle, capture and seize the loop. Afterwards, move the remote operated vehicle out of the area of the axis of the anchoring line's descent;

Continue sinking the anchoring line until the entire quick anchoring system is positioned on the sea bed;

Steer the remote operated vehicle in the direction of the shackle;

Pass the loop through the shackle with the help of the remote operated vehicle;

Steer and track the remote operated vehicle to the buoy connected to the fastener;

Connect the loop to the fastener with the aid of the remote operated vehicle;

Pull/hoist the anchoring line;

Take the other end of the anchoring line, keeping it taut, to the structure that needs to be anchored.

Thirdly, the invention includes a method to detach the quick anchoring system from the fixedly attached anchoring device on the sea bed, as described in the following steps:

A boat takes the dry end of the anchoring line of an anchored structure;

Drive the boat to a position on the surface of the ocean that is over the dragging device, always keeping the anchoring line taut;

At this point, lower the anchoring line down until it reaches the quick anchoring system positioned on the sea bed;

With the remote operated vehicle, locate the buoy;

Detach the loop from the fastener next to the buoy;

Hoist the anchoring line with the attached quick anchoring system.

BRIEF DESCRIPTION OF THE ILLUSTRATIONS

The invention will now be presented at greater length, together with the related illustrations below (as an example only), which are included with the present report, of which they are an integral part, and in which.

DETAILED DESCRIPTION OF THE INVENTION

The invention is comprised of anchoring equipment for floating structures, developed to allow fast connection and disconnection of an anchoring line to an anchoring device fixedly attached to the sea bed, and uses only one boat and a remote operated vehicle (hereinafter referred to as simply ROV) to carry out the anchoring procedure.

Figure 1:
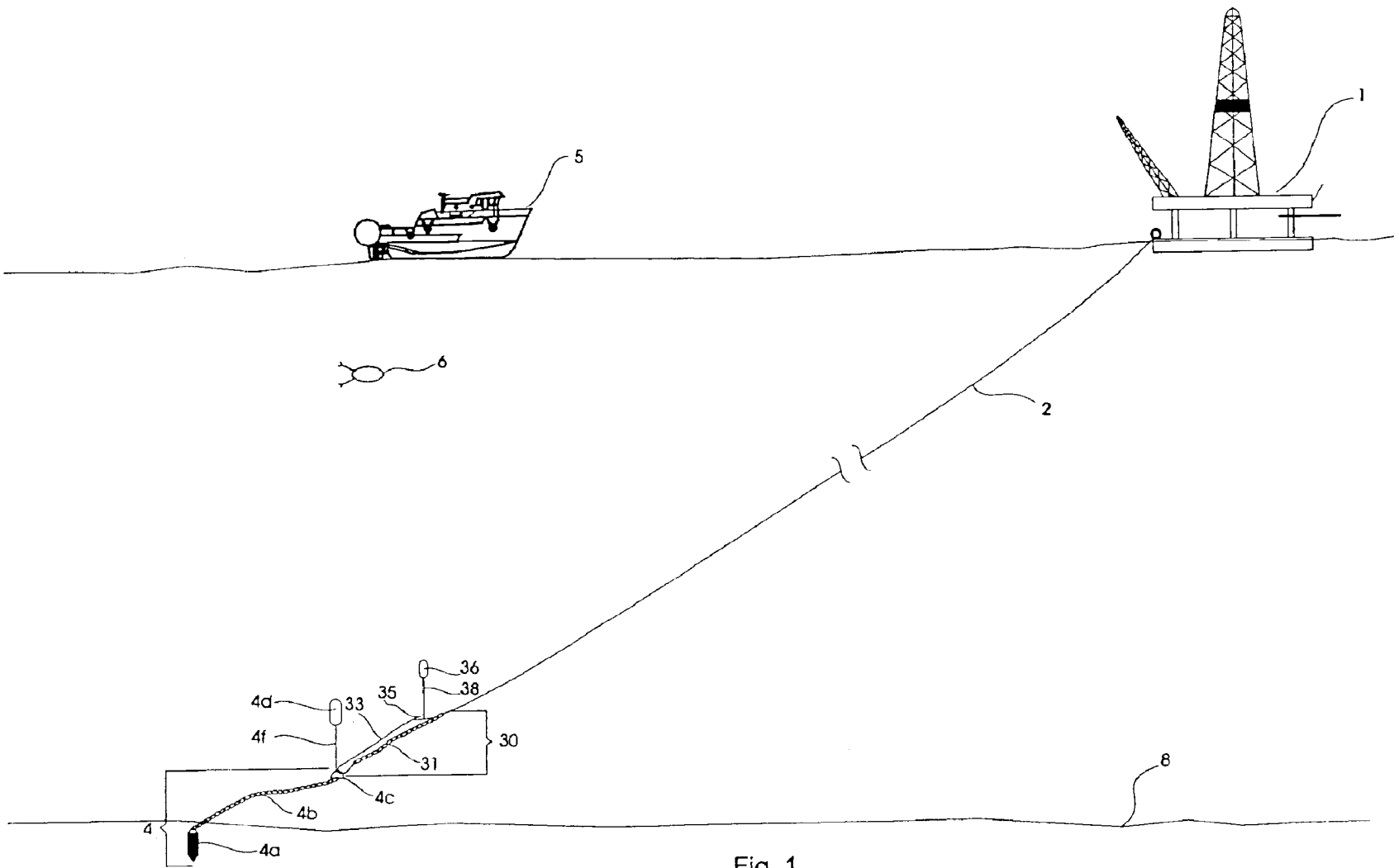
FIG. 1 shows the preferred final application of the anchoring system, showing a panoramic view of the quick anchoring system.

FIG. 1 shows a broad view of a preferred final application of the invention, used to anchor a (1) floating platform structure. Quick anchoring equipment (30) (the object of this invention) is attached to the submerged end of an anchoring line (2) by known technical methods of anchorage, and this is connected to an anchoring system (4) fixedly attached to the sea bed (8).

The anchoring system (4) includes an anchoring device **(4*a*), an anchor chain cable (4*b*), and a shackle (4*c*). The anchoring device (4*a*) can be a stake, an anchor, or any other anchoring device. The anchor chain cable (4*b*) has one of its ends attached to the anchoring device (4*a*), and the shackle (4*c*) is connected to the other end of the anchor chain cable (4*b*)**.

The anchoring device **(4*a*) was fixedly attached to the sea bed (8)** beforehand by means of the usual technique, which will not be described here since it is not part of the invention and is already known by specialists.

Figure 2:
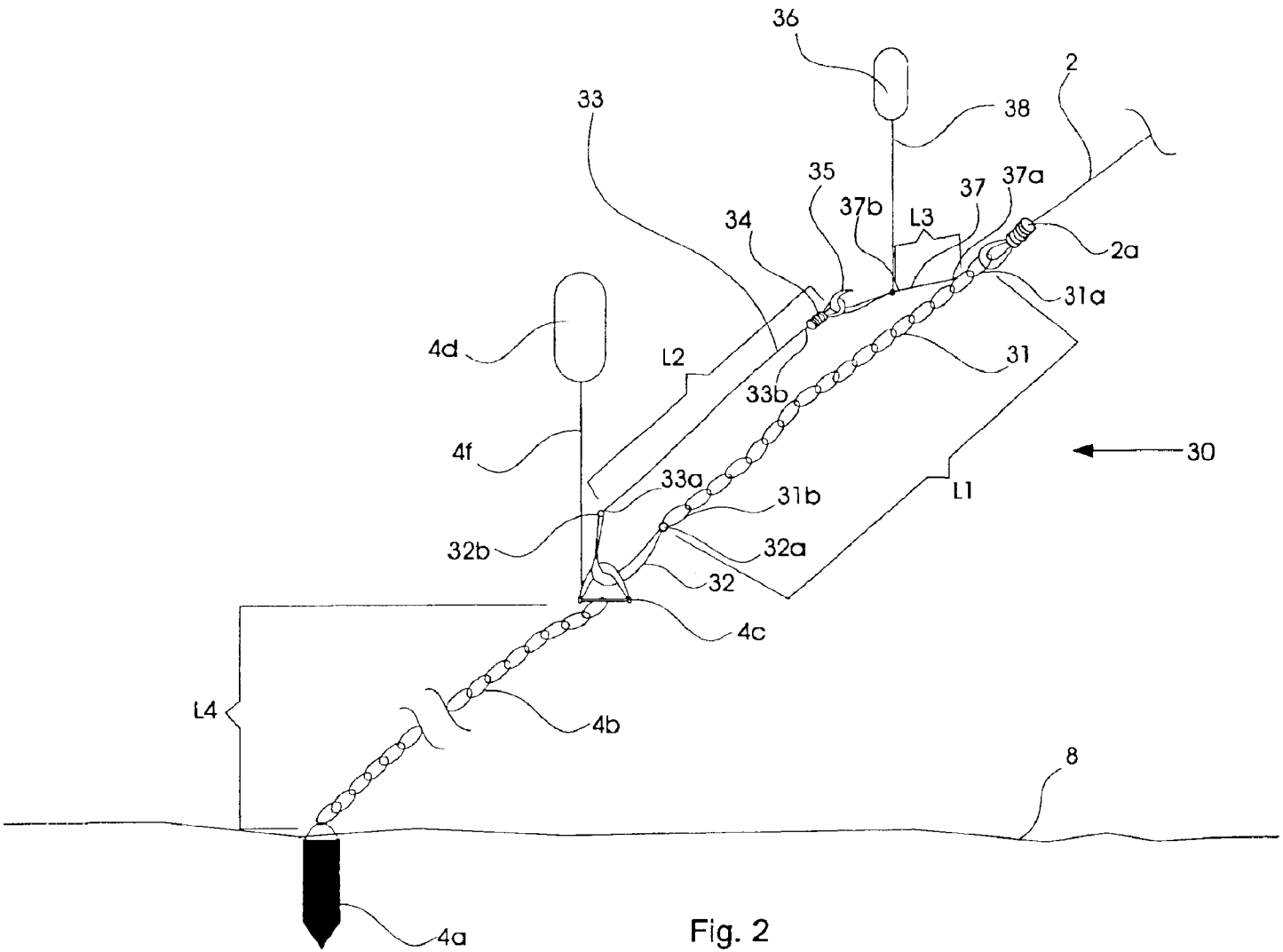
FIG. 2 shows a more detailed view of the quick anchoring system which is the object of the present invention.

FIG. 2 shows many more details of the quick anchoring equipment (30) (object of the present invention), which is connected to the anchoring system (4) and the anchoring line (2), as will be seen in greater detail later.

The surface of the sea bed (8) is usually constituted by a thick layer of very fine particles that creates a kind of mud. Any movement close to the surface of the sea bed (8) causes a large amount of these particles to rise up, which turns it into an area of poor visibility (7). Under these conditions, visibility needed to accomplish any operation requiring visual accuracy is lost, whether the operation is being carried out by divers, or by other remotely operated systems, for example, a remote operated vehicle (ROV).

To connect the quick anchoring equipment (30) to the anchoring system (4), all the quick anchoring equipment (30) must be positioned on the sea bed (8), and, in order to do this, the quick anchoring equipment (30) is simply allowed to fall to the sea bed (8), in a controlled way, using a support boat.

The operation to place the quick anchoring equipment (30) on the sea bed (8) stirs up the particles on the ocean floor, setting them into suspension, which makes it difficult to carry out the rest of the steps. Therefore, it is necessary to wait until these suspended particles resettle on the sea bed (8), which causes a loss of time.

To eliminate this inconvenience, the shackle (4*c*) is kept at the minimum height (L4) from the sea bed as previously established (8), using a buoy (4*d*), so that the area of poor visibility (7) does not delay the execution of the steps of the quick anchoring process. The ideal height is between 1.5 and 2.5 meters, with the optimal height being two meters, although it is not limited to these values.

Also in FIG. 2, details can be seen of the elements that make up the quick anchoring equipment (30), that connect the anchoring system (4) to the lower end of the anchoring line (2). The quick anchoring equipment (30) basically includes a chain cable segment (31), a hook (32), a fastener (35), a fairlead (33), a cable segment (37) and a floatation device (36).

The anchoring line (2), which may include a synthetic cable or steel cable, or a chain cable, has a connector on its submerged end (2*a*), which may be a shackle, a link or a socket, or any other known technical device for linkage. The connector (2*a*) is attached to the first end (31*a*) of the quick anchoring equipment (30) chain cable segment (31).

An open ring, or hook (32) has its connector end (32*a*) connected to a second end (31*b*) of the chain cable segment (31). In this invention, it is preferable to use the hook that was the object of the aforementioned patent BR-PI-9700787 in order to fulfill the function of the hook (32). This hook is the best one for this function, due to the way it is constructed, and any accessories that are needed eventually may be installed later.

The chain cable segment (31) is provided with a length of cable (L1) that parallels the precision ray [laser] that a support boat (5) on surface of the ocean uses to lower the entire quick anchoring equipment (30) towards the anchoring system (4) on the sea bed (8). This precision depends on the margin of error of the anchoring device's positioning system (4*a*) and the ocean currents at the moment the anchoring line is lowered (2).

The length of cable (L1) on the chain cable segment (31) must allow sufficient clearance for the ROV (6) to perform maneuvers, which is used in two of the fast connection procedural steps, as will be seen below. Preferably, this length (L1) of cable should be between 20 and 35 meters, with the optimal length being 25 meters, although it is not limited to these values.

The first end (37*a*) of the cable segment (37) is also connected to the first end (31*a*) of the segment of chain cable (31). The aforementioned cable segment (37) should preferably be a steel cable. A second end (37*b*) of the cable segment (37) is connected to a fastener (35), that may be a hook. A floatation device (36) is also connected to the second end (37*b*) of the cable segment (37), by way of a linking element (38), with which the loop (35) is kept under tension.

The cable segment (37) is extended by a length of cable (L3) sufficient to keep the fastener (35) away from the chain cable segment (31), when the chain cable is positioned on the sea bed (8). In this way, the fastener (35) will always remain out of the area of poor visibility (7). In this final application, the length (L3) of the cable segment (37) may be between 1.5 and 2.5 meters, with the optimal length being 1.5 meters, although it is not limited to these values.

The last element of the quick anchoring equipment (30) is a fairlead (33), which preferably will be a braided steel cable. The first end (33*a*) of the fairlead (33) is attached to the ring end (32*b*) of the hook (32). The second end (33*b*) of the fairlead (33) is provided with a loop (34).

The length (L2) of the fairlead (33) is equal to the difference between the length (L1) of the chain cable segment (31) and the length (L3) of the cable segment (37). The length (L2) of the fairlead (33) must be sufficient to allow clearance for the ROV's maneuvers (6).

The invention also includes a method for the fast connection and disconnection of the quick anchoring equipment (30) to/from an anchoring system (4) previously fixedly attached to the sea bed (8). Only one boat (5) and an ROV (6) are used to carry out the fast connection and the disconnection to/from the quick anchoring equipment (30).

The description of the method will be made based on FIGS. 3 thru 7. It should be noted that the inventive concept that is described below has no limitations, and a specialist who possesses technical skills will recognize that possibilities exist to modify the sequence, to include or to eliminate certain steps of the method of operation. These alterations are within the scope of the method of the invention.

Figure 3:
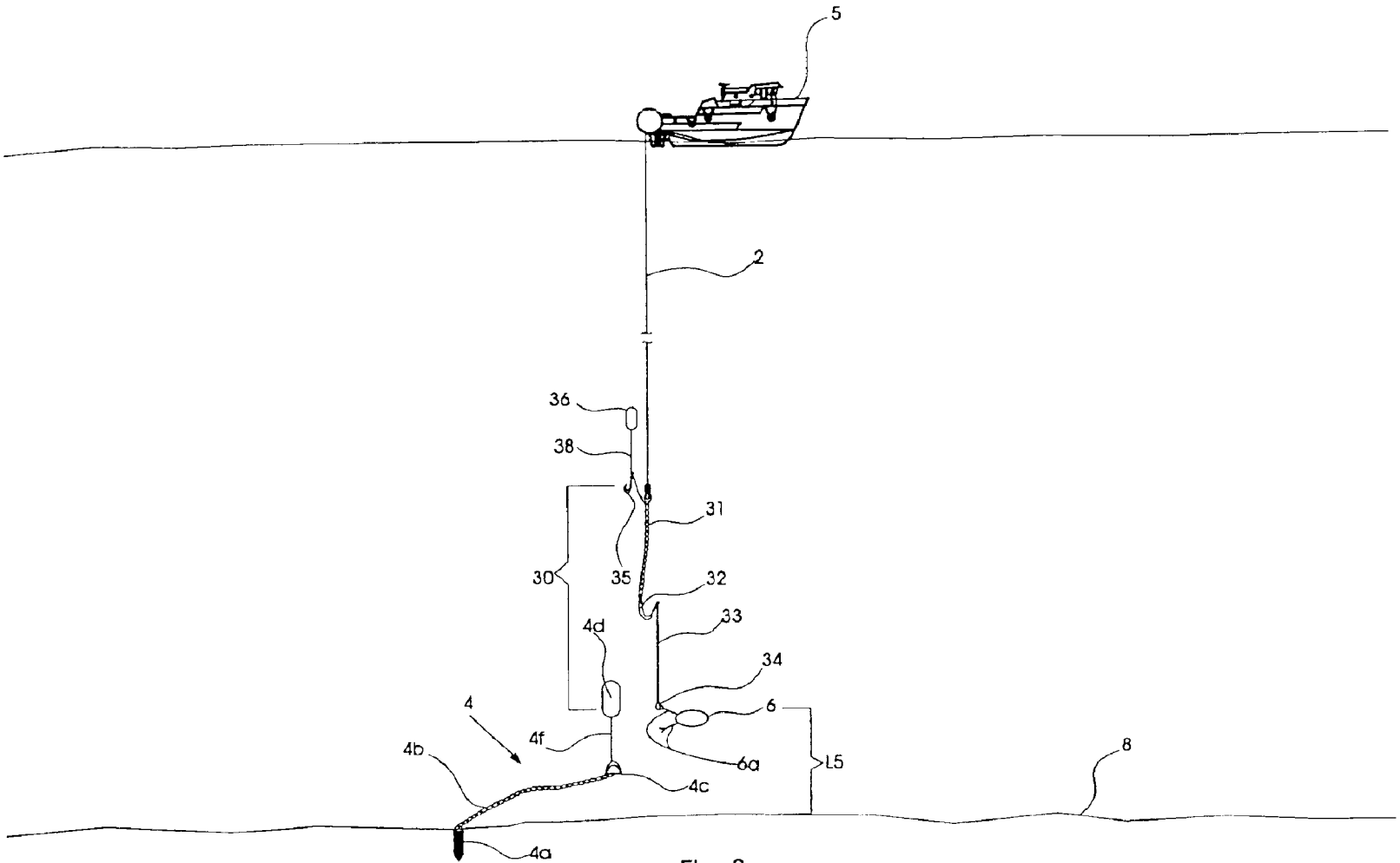
FIG. 3 shows the positioning and sinking stage of the quick anchoring equipment.

Starting with FIG. 3, one can check the first of the procedures to connect an anchoring line (2) to an anchoring system (4), previously fixedly attached to the sea bed (8), as it was mentioned previously.

A boat (5) carries the anchoring line (2), which is already duly provisioned with the quick anchoring equipment on one of its ends (30), to a position on the surface of the ocean where the boat (5) vertically locates the anchoring system (4).

An anchoring line (2), which is connected on its submerged end to the quick anchoring equipment (30), is lowered from the boat (5), as seen in FIG. 3. In this stage of the process, the loop (34) is still not connected to the fastener (35).

In this situation, the quick anchoring equipment (30) is totally extended, and the second end of the fairlead (33*b*) (which has a loop on this end) (34), is turned towards the sea bed (8), located thusly below the chain cable segment (31). The total length of the quick anchoring equipment (30) will then be approximately equal to the sum of lengths (L1) and (L2).

The process of sinking the anchoring line (2) is interrupted when the quick anchoring equipment (30) approaches the sea bed (8) at the minimum distance (L5) previously established, in such a manner that the loop (34) remains close to the sea bed (8), without actually touching it.

After that, as shown in FIG. 3, the ROV (6) approaches the loop (34) and, by using its claws (6*a*), captures and seizes the loop (34), and moves it away for the distance previously established, in order not to jeopardize the operation.

Length (L5) may be the half of the length (L2) of the fairlead (33), since at this height the loop (34) will be out of the area of poor visibility that will be formed, and it may be captured by the ROV's (6) claws (6*a*), and will not cause pull on the ROV (6) when all the quick anchoring equipment (30) is positioned on the sea bed (8).

Figure 4:
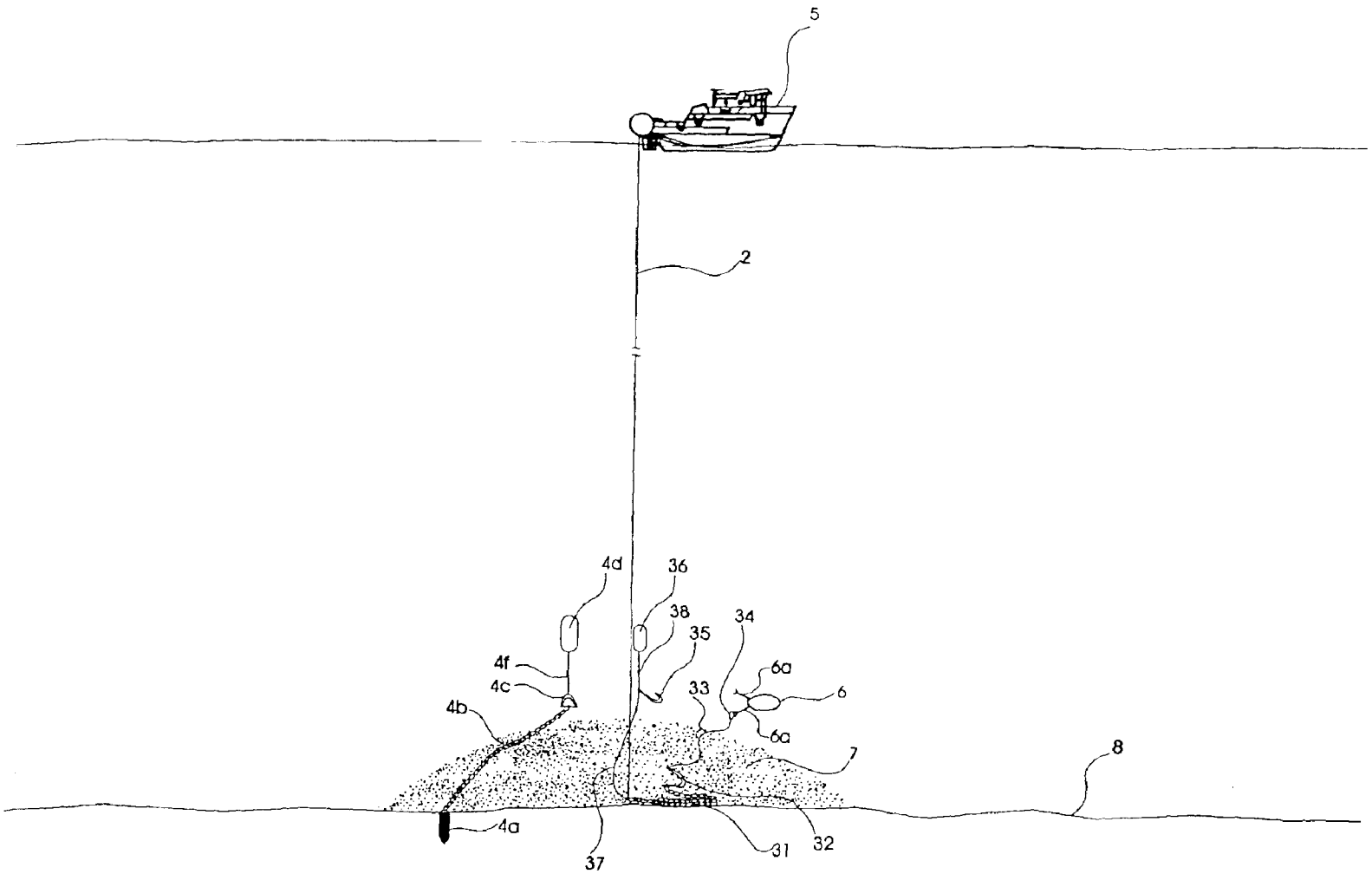
FIG. 4 shows the beginning of the steps of operation using the remote operated vehicle.

Afterwards, the anchoring line (2) continues to be lowered, until all the quick anchoring equipment (30) is positioned on the sea bed (8), as shown in FIG. 4.

Figure 5:
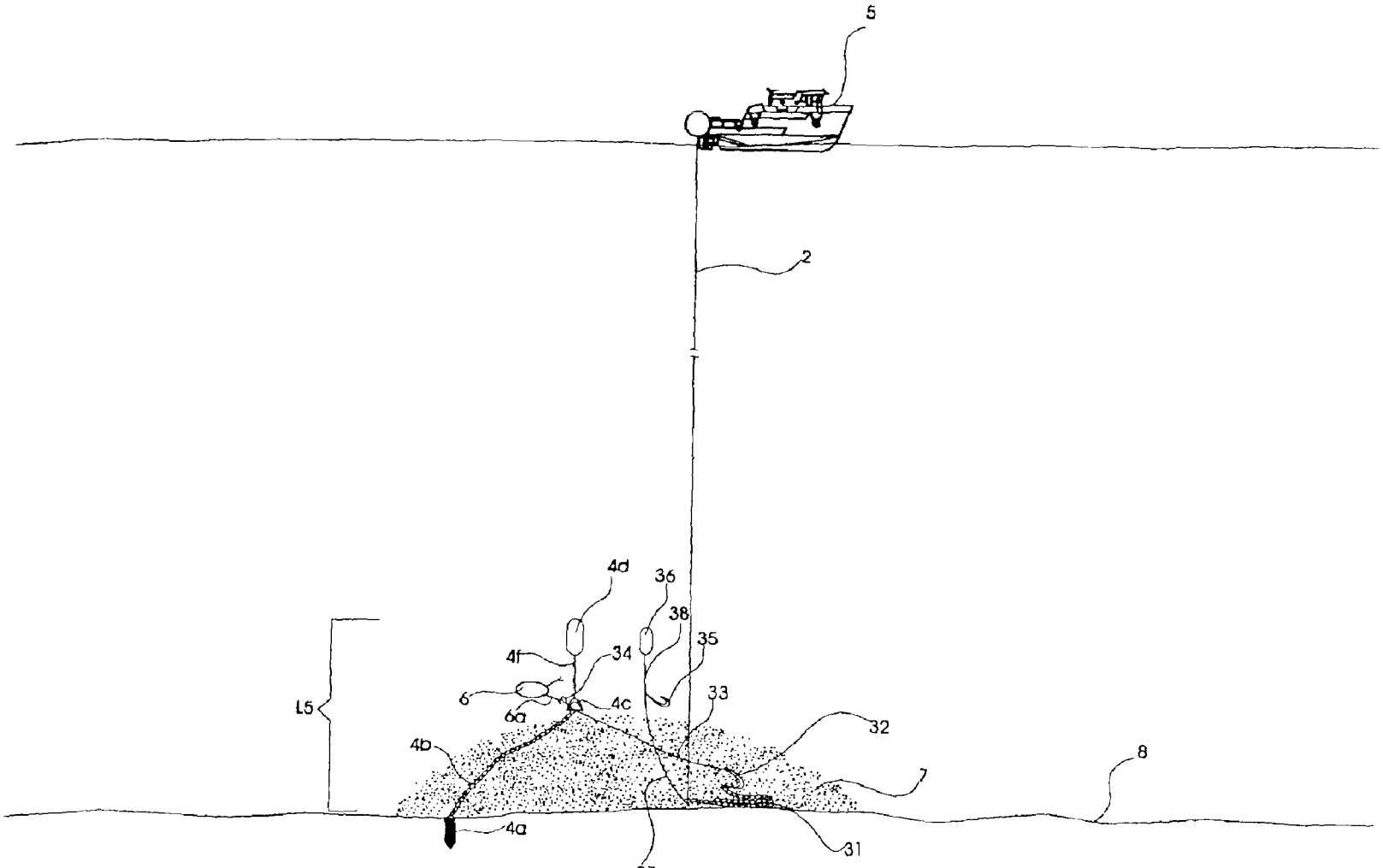
FIG. 5 shows the remote operated vehicle in operation, transferring the connecting cable through the shackle.

Placing the quick anchoring equipment (30) on the sea bed (8) creates a situation that favors the formation of an area of poor visibility (7), as shown in FIG. 5. However, as previously mentioned, the ROV (6) can carry out the following anchoring steps, because the floatation device (36) will perform as long as the loop (35) remains out of the area of poor visibility (7). The buoy (4*d*) will also perform as long as the shackle (4*c*) stays out of the area of poor visibility (7).

Then, maneuver the ROV (6) in the direction of shackle (4*c*). Right after that, the ROV (6) then slips the loop (34) through the shackle (4*c*), as shown in FIG. 5. Check that the ROV (6) still retains the loop (34) after to slipping the loop (34) through the shackle (4*c*).

Figure 6:
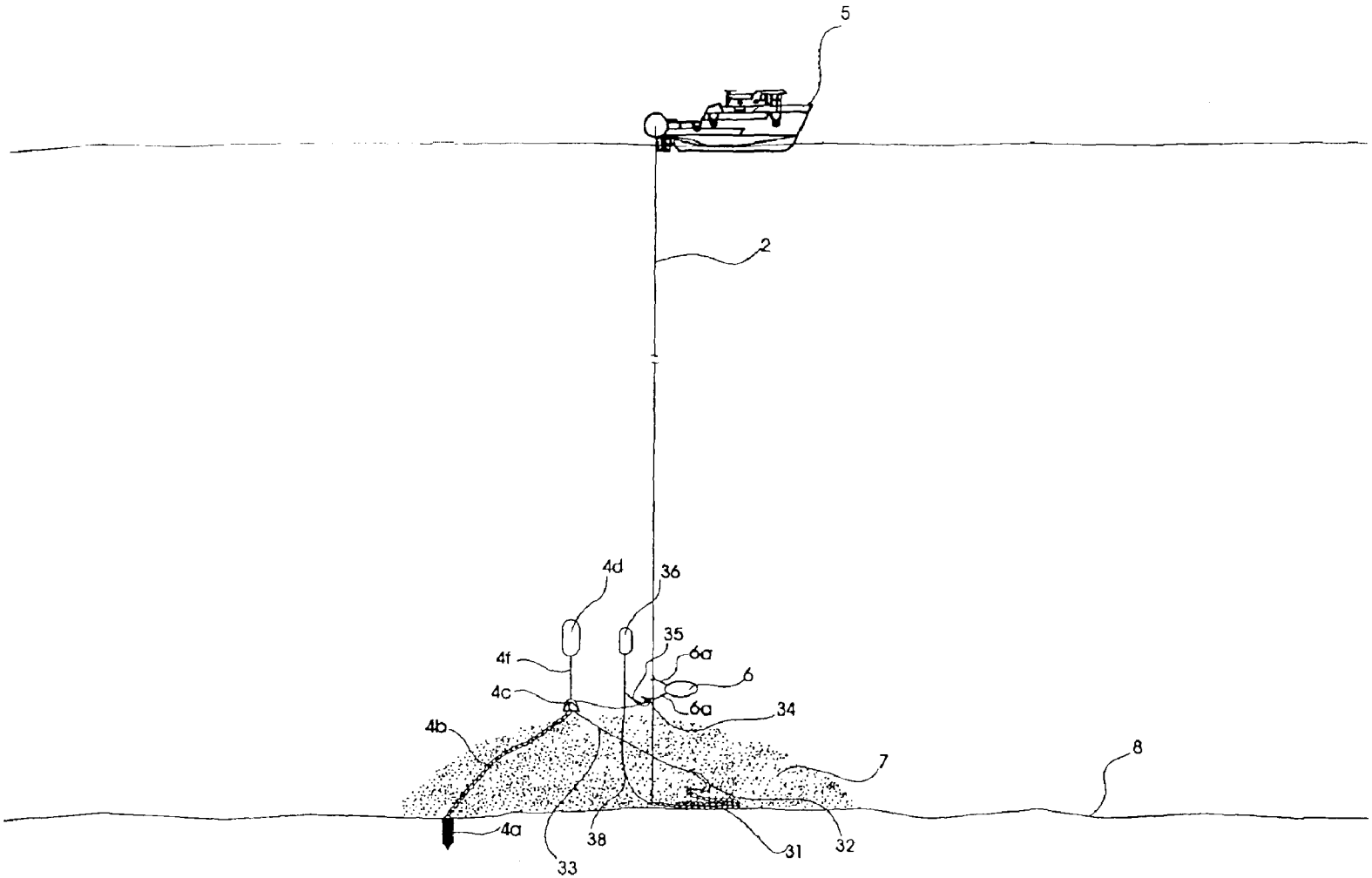
FIG. 6 shows the remote operated vehicle fastening the connecting cable to the cable segment with the floating fastener.
Figure 7:
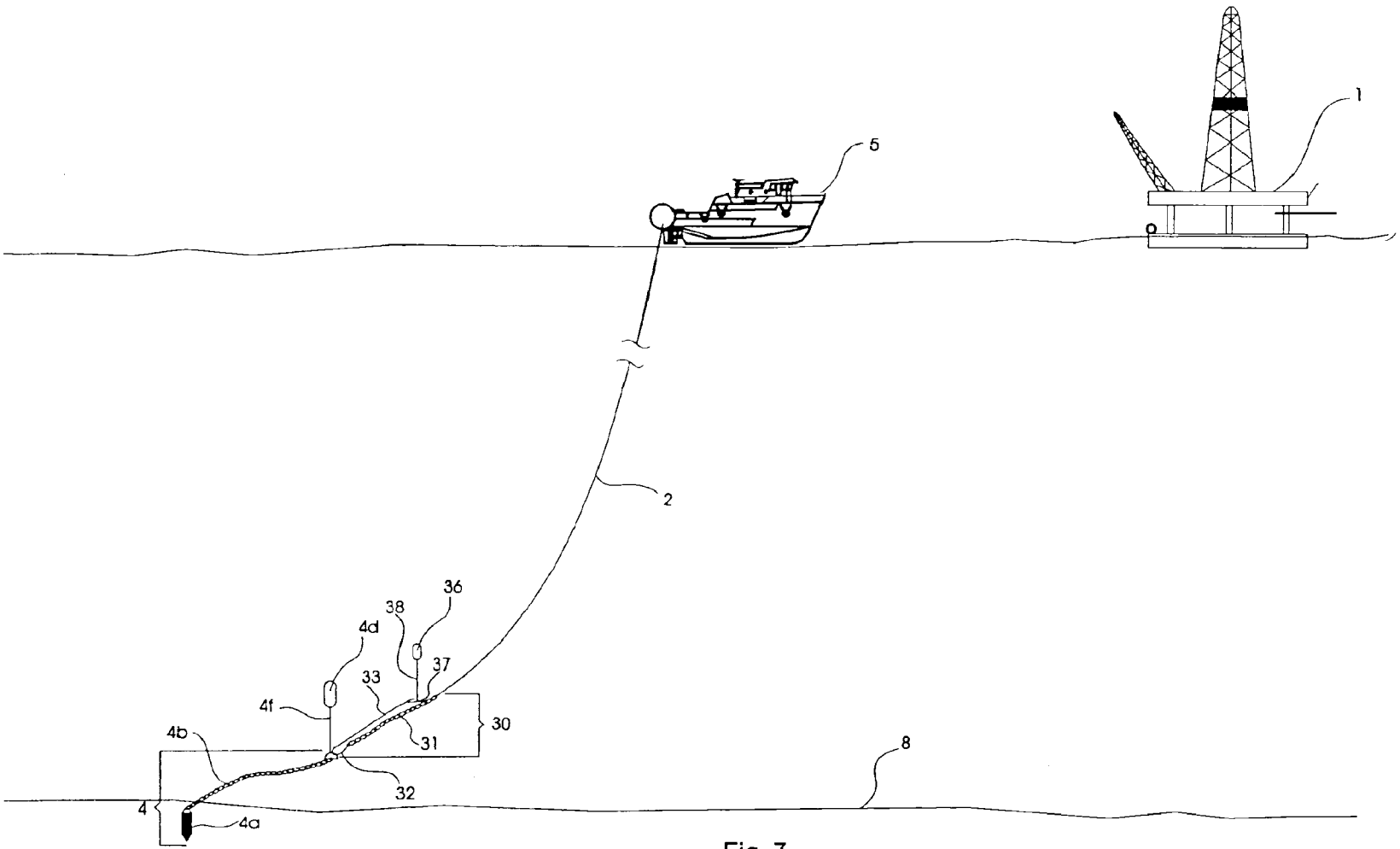
FIG. 7 shows the tugboat pulling the anchoring line and finishing the connection of the quick anchoring system.

After that (as shown in FIG. 6), the ROV (6) is driven towards the floatation device (36), which supports the loop (35) to keep it out of the area of poor visibility (7). With this, the fairlead (33) passes through the opening of the shackle (4*c*), as the ROV (6) shackle (4*c*) moves in the direction of the floatation device (36).

With the help of its claws (6*a*), the ROV (6) connects the loop (34) to the fastener (35). After that, the anchoring line (2) is hoisted, and, consequently, the fairlead (33) will guide the hook (32) in direction of the shackle (4*c*), to put them together forming the connection, as it can be seen in FIG. 7. Under this condition, the floatation device (36) keeps the fairlead (33) taut.

Tension is maintained on the anchoring line (2) by the boat (5), and to the other end of the anchoring line (2), which is on the surface, in the boat (5). It is then connected to the floating structure (1), by the existing tensioning devices on this floating structure (1). This finalizes the anchoring procedure, which at this point assumes the configuration shown in FIG. 1.

Figure 8:
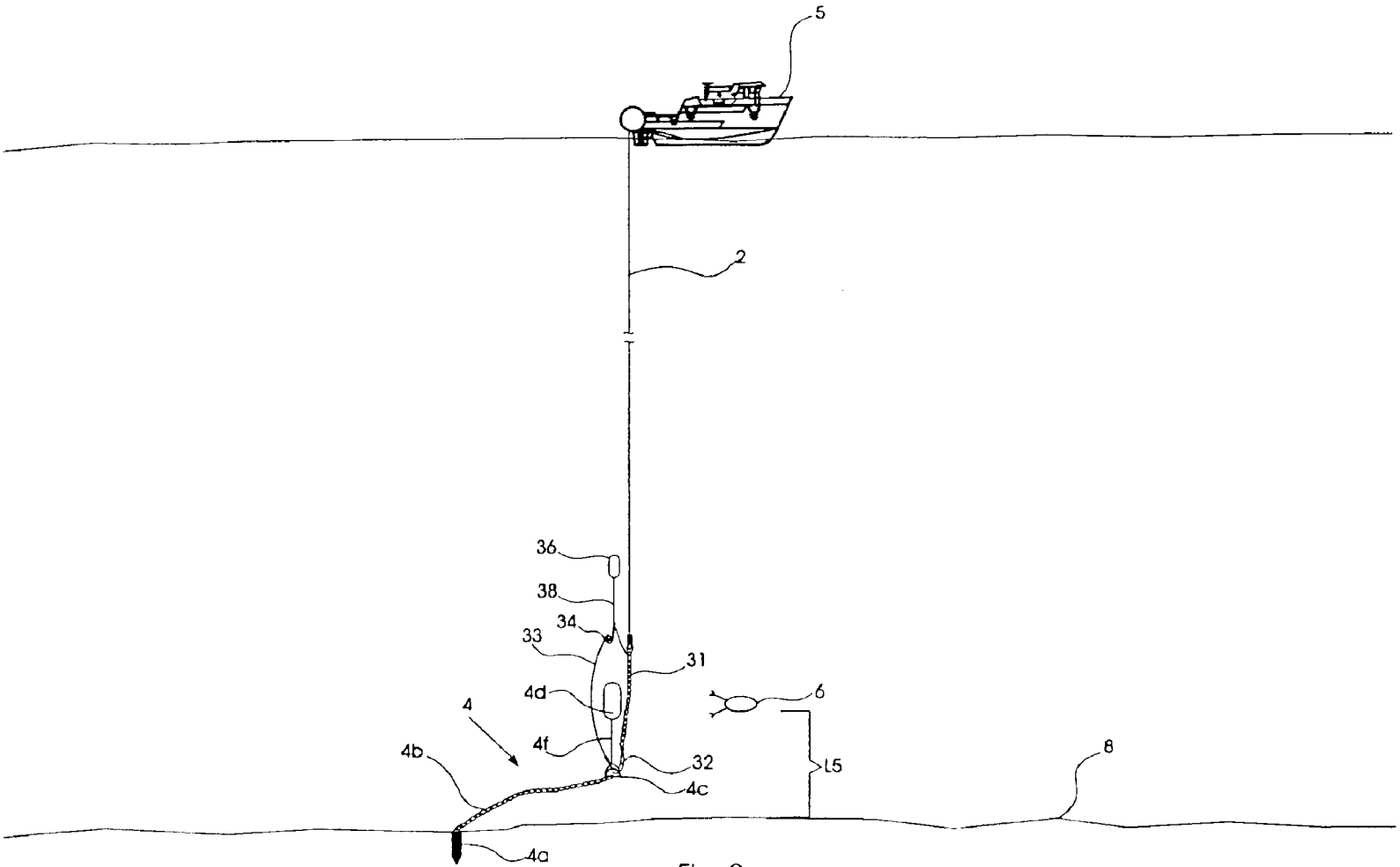
FIG. 8 shows the main stage of disconnecting the quick anchoring equipment from the shackle.

The disconnection operation is accomplished by reversing the order of the connection operation:

A boat (5) takes the end of the anchoring line (2) that it was connected to the floating structure (1). The boat (5) then moves to a position on surface of the ocean located directly above the anchoring system (4) in a vertical line. The anchoring line (2) must be kept taut, as shown in FIG. 8.

At this point, the anchoring line (2) is lowered slowly towards the sea bed (8), until the quick anchoring equipment (30) is positioned on the sea bed (8). While lowering the quick anchoring equipment (30) (and before it completely is positioned on the sea bed) (8), the hook (32) (which is in the vertical position), will automatically become detached from the shackle (4*c*).

The disconnection occurs through the action of gravity on the hook (32), as a result of the force of the thrust provided by the buoy (4*d*), as long as the shackle (4*c*) stays in a stable vertical position.

Using the ROV (6), the position of the floatation device is located (36) outside the area of poor visibility (7). With the ROV, the loop is detached or cut (34) from the fastener (35), using existing cutting tools located in the claws (6*a*) of the ROV (6).

After that, the entire anchoring line is hoisted (2) together with the quick anchoring equipment (30) attached to its end.

The invention has been described herein with reference made to its preferred final applications. However, it must be clarified that the invention is not limited to only these applications, and those with technical abilities will immediately realize that alterations and substitutions can be made without straying from the described inventive concept.

List of Components (1) Floating structure
(2) Anchoring line
(2*a*) Connector
(4) Anchoring system
(4*a*) Anchoring device
(4*b*) Anchoring chain cable
(4*c*) Shackle
(4*d*) Buoy
(5) Boat
(6) Remote operated vehicle (ROV)
(6*a*) Claw (of the ROV)
(7) Area of poor visibility
(8) Sea bed
(30) Quick anchoring equipment
(31) Segment of chain cable
(31*a*) First end of the segment of chain cable
(31*b*) Second end of the segment of chain cable
(32) Hook
(32*a*) Connector end of hook
(32*b*) Ring end of hook
(33) Fairlead
(33*a*) First end of fairlead
(33*b*) Second end of fairlead
(34) Loop
(35) Fastener
(36) Floatation device
(37) Segment of cable
(37*a*) First end of the cable segment
(37*b*) Second end of the cable segment
(38) Linking element

What is claimed is:

1. Quick anchoring equipment, which includes the following components:

a segment of chain cable having a first length (L1);

a hook;

a fastener;

a fairlead having a second length (L2);

a segment of cable having a third length (L3); and a floatation device, which are mounted together which connect an anchoring line to an anchoring system, which includes:

an anchoring device, fixedly attached to the sea bed;

an anchor chain cable, one end of which is attached to the anchoring device; and a shackle, which is supported by a buoy and is connected to another end of the anchor chain cable;

wherein:

a first end of the segment of chain cable is connected to the anchoring line, through a connection;

the hook has a connecting end connected to a second end of the segment of chain cable;

a first end of the segment of cable is also connected to the first end of the segment of chain cable;

a second end of the segment of cable is connected to the fastener;

the floatation device is also connected to the second end of the segment of cable, through a linking element;

a first end of the fairlead is attached to the hook, a second end of the fairlead is provided with a loop;

the length of the segment of chain cable will parallel a precision ray used by a boat to place itself above the position of the anchoring device on the sea bed;

the length of the segment of cable is sufficient to hold the fastener out of an area of poor visibility on the sea bed; and a length (L1) of the fairlead is equal to the difference between the length (L1) of the segment of chain cable and the length (L3) of the segment of cable.

2. Quick anchoring equipment in accordance with claim 1, characterized by the length of chain cable measures between 20 and 35 meters.

3. Quick anchoring equipment in accordance with claim 2, characterized by the length of chain cable is 25 meters.

4. Quick anchoring equipment in accordance with the claim 1, characterized by the hook having one free end provided with a ring, the first and of the fairlead being attached to said ring.

5. Quick anchoring equipment in accordance with claim 1, characterized by the fairlead and the cable segment are each comprised of a steel cable.

6. Quick anchoring equipment in accordance with claim 1, characterized by the length (L3) of the segment of cable is sufficient to hold the fastener out of an area of poor visibility on the sea bed.

7. Quick anchoring equipment in accordance with claim 6, characterized by the length (L3) of the segment of cable measures between 1.5 and 2.5 meters.

8. Quick anchoring equipment in accordance with claim 7, characterized by the segment of cable has a length of 1.5 meters.

9. Quick anchoring equipment in accordance with claim 1, characterized by the fairlead and the cable segment are each manufactured from synthetic material.

10. Quick anchoring equipment in accordance with claim 1, characterized by a length (L4) of anchor chain cable is longer than a height of an area of poor visibility on the sea bed.

11. Quick anchoring equipment in accordance with claim 10, characterized by the length (L4) of the anchor chain cable measures between 1.5 and 2.5 meters.

12. Quick anchoring equipment in accordance with claim 11, characterized by the length (L4) of the anchor chain cable has a length of 2 meters.

13. Quick anchoring equipment, in accordance with claim 11, characterized by the length of the anchor chain is cable half of the length of the fairlead.

14. Method to use the quick anchoring equipment in accordance with claim 1, for the connection of an anchoring line to an anchoring system, the method being characterized by the following steps:

in a boat, carry the anchoring line to a position on the surface of the ocean that is vertically over the anchoring system, wherein the quick anchoring equipment is attached to one end of said anchoring line;

lower the anchoring line, provided with the quick anchoring equipment, in such a way that said anchoring line is fully extended and a second end of the fairlead is turned towards the sea bed, and located below the segment of chain cable;

stop the descent of the anchoring line when the loop is located at distance above the floor of the ocean;

capture and seize the loop, located on the second end of the fairlead, using the claws of an ROV, the ROV will then move away;

continue lowering the anchoring line until the entire quick anchoring equipment is placed on the sea bed;

move the ROV in the direction of the shackle;

slip the loop through the shackle, with the help of the ROV;

move the ROV in the direction of the floatation device, which is connected to the fastener, that the fairlead will pass through the shackle;

connect the loop to the fastener, with the help of the ROV's claws;

pull and hoist the anchoring line;

while in the boat, connect the other end of the anchoring line to a floating structure, use existing tensioning devices on the floating structure to apply tension to the anchoring line, until the desired configuration is obtained.

15. Method to use the quick anchoring equipment in accordance with claim 1, in order to disconnect an anchoring line from an anchoring system, the method being characterized by the following steps;

bring the end of the anchoring line that was connected to a floating structure into a boat;

drive the boat to a position on the surface of the ocean that is located vertically over anchoring system;

keep the anchoring line taut;

lower the anchoring line at this point until the quick anchoring equipment is placed on the sea bed;

with the help of an ROV locate the floatation device and consequently the fastener;

disconnect the loop of the fastener next to the floatation device; and hoist the anchoring line with the quick anchoring equipment attached to the end.

* * * * *